US010357085B2

(12) United States Patent
Heller

(10) Patent No.: US 10,357,085 B2
(45) Date of Patent: Jul. 23, 2019

(54) JEWELRY ENHANCER

(71) Applicant: Jacqueline Heller, Los Angeles, CA (US)

(72) Inventor: Jacqueline Heller, Los Angeles, CA (US)

( * ) Notice: Subject to any disclaimer, the term of this patent is extended or adjusted under 35 U.S.C. 154(b) by 151 days.

(21) Appl. No.: 15/417,166

(22) Filed: Jan. 26, 2017

(65) Prior Publication Data

US 2018/0008015 A1 Jan. 11, 2018

Related U.S. Application Data

(60) Provisional application No. 62/360,342, filed on Jul. 9, 2016.

(51) Int. Cl.

| | |
|---|---|
| ***A47C 1/00*** | (2006.01) |
| ***A44C 5/24*** | (2006.01) |
| ***A44C 5/20*** | (2006.01) |
| ***A44C 25/00*** | (2006.01) |
| ***A44C 5/18*** | (2006.01) |
| ***A44C 1/00*** | (2006.01) |

(52) U.S. Cl.

CPC ..... *A44C 1/00* (2013.01); *A44C 5/209* (2013.01); *A44C 5/2009* (2013.01); *A44C 25/001* (2013.01)

(58) Field of Classification Search

CPC ..... A44C 1/00; A44C 5/209; A44C 5/2009; A44C 25/001; A44C 17/0208; A44C 9/00; A44C 9/003; A44C 15/001; A44C 5/2019; A44C 5/2033; A44C 5/2038; A44C 5/185; A44C 5/24; Y10T 24/4657; F16B 45/02; F16B 45/06; F16B 45/00

USPC ..... 63/3.1; 24/369, 370, 376

See application file for complete search history.

(56) References Cited

U.S. PATENT DOCUMENTS

| | | | | |
|---|---|---|---|---|
| 87,072 | A * | 2/1869 | Rowland | A45D 8/24 132/279 |
| 645,108 | A | 3/1900 | Lincks | |
| 686,197 | A | 11/1901 | Bippart | |
| 1,708,911 | A * | 4/1929 | Szymanski | B60C 27/08 24/376 |
| 3,181,217 | A | 5/1965 | Bohlinger | |
| 3,307,375 | A * | 3/1967 | Estrin | A44C 9/0015 63/15 |
| 4,742,695 | A | 5/1988 | Elsner | |
| 5,156,023 | A | 10/1992 | Bevolo | |
| 5,184,481 | A | 2/1993 | Joseph | |
| 5,353,608 | A | 10/1994 | Berkowitz | |

(Continued)

FOREIGN PATENT DOCUMENTS

| | | |
|---|---|---|
| FR | 428180 | 8/1911 |
| FR | 2679111 | 1/1993 |
| FR | 2965706 | 4/2012 |

*Primary Examiner* — Robert Sandy
*Assistant Examiner* — Rowland Do

(57) ABSTRACT

A jewelry enhancer is provided which may repurpose items of jewelry, display items of jewelry and be worn as an adornment. The jewelry enhancer includes a plurality of hinged rings, capable of opening, closing and securing multiple strands of string jewelry therethrough. The jewelry enhancer further includes a button-clip that can secure and display shank buttons, a bar pin capable of affixing the jewelry enhancer to garments, a jewelry bale capable of attaching the jewelry enhancer to items of string jewelry and a brooch bar capable of eclipsing the button-clip for a fashionable effect.

9 Claims, 5 Drawing Sheets

(56) References Cited

U.S. PATENT DOCUMENTS

| | | | | |
|---|---|---|---|---|
| 5,669,241 | A * | 9/1997 | Kohl | A44C 9/0015 63/15.1 |
| 6,318,122 | B1 * | 11/2001 | Burgard | A44C 9/00 63/15 |
| 6,422,036 | B1 | 7/2002 | Giannia | |
| D556,620 | S | 12/2007 | Chan | |
| 7,841,571 | B1 * | 11/2010 | Ghormley | F16L 3/085 24/373 |
| D665,292 | S | 8/2012 | Jackson | |
| 10,111,545 | B1 * | 10/2018 | Shapiro | F16B 45/02 |
| 2004/0177647 | A1 | 9/2004 | Dennis | |
| 2010/0223954 | A1 | 9/2010 | Kim | |
| 2013/0199239 | A1 | 8/2013 | Walker | |
| 2015/0089976 | A1 | 4/2015 | Alulis | |

* cited by examiner

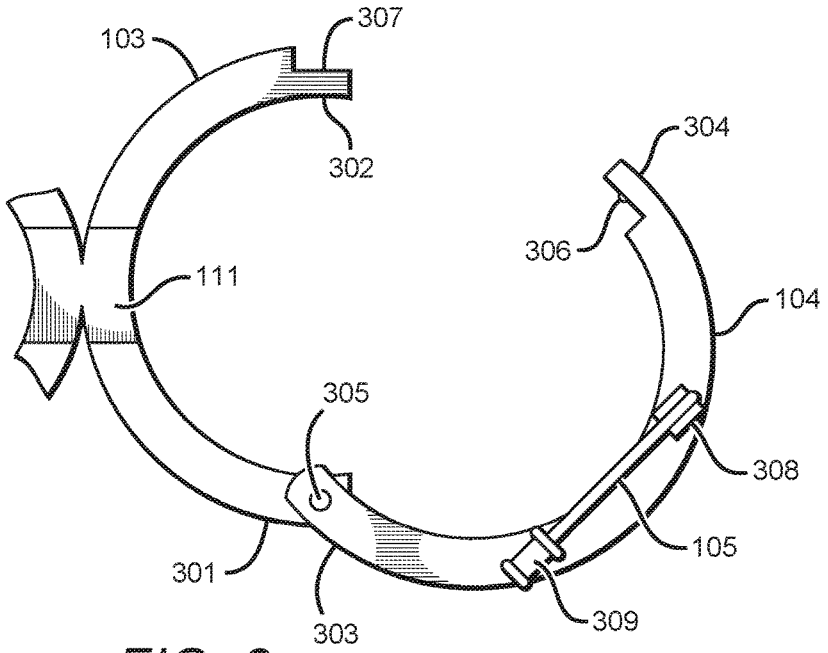
FIG. 3
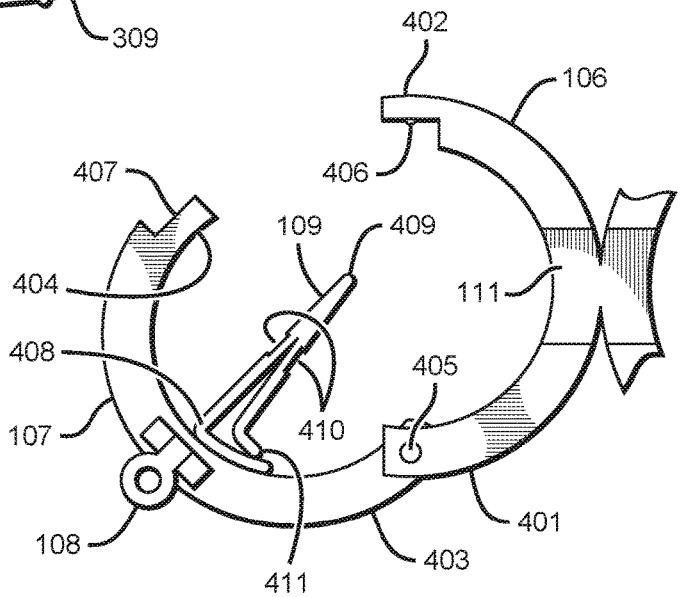
FIG. 5
FIG. 4
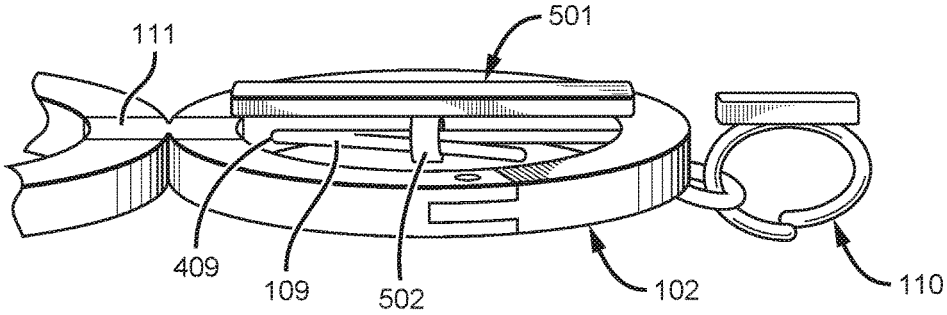

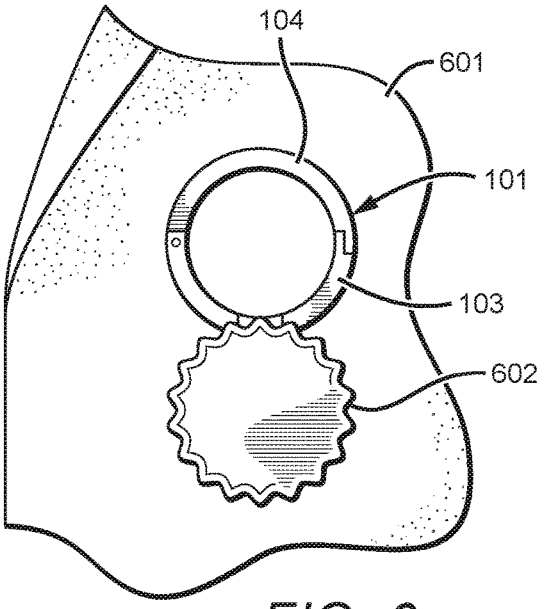
FIG. 6
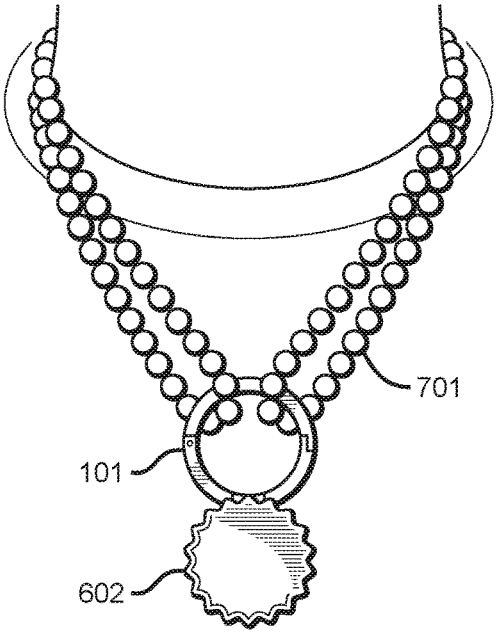
FIG. 7
FIG. 8
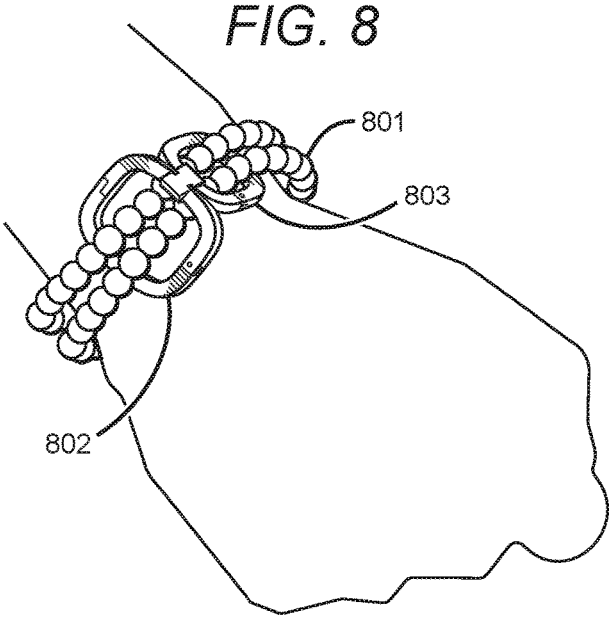
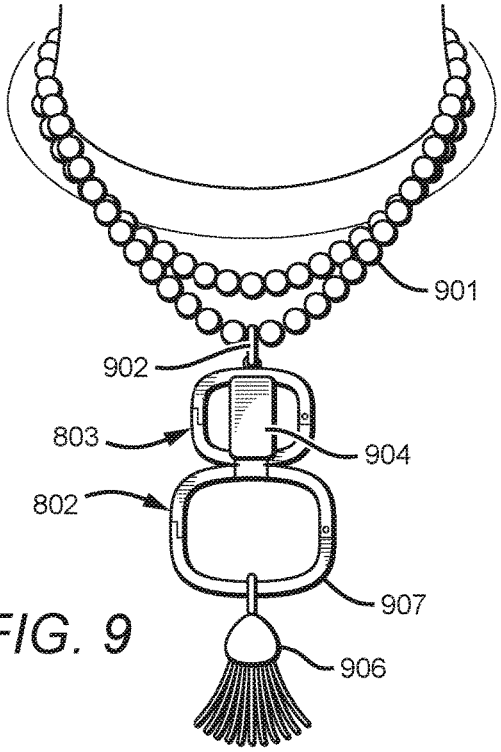
FIG. 9

FIG. 10
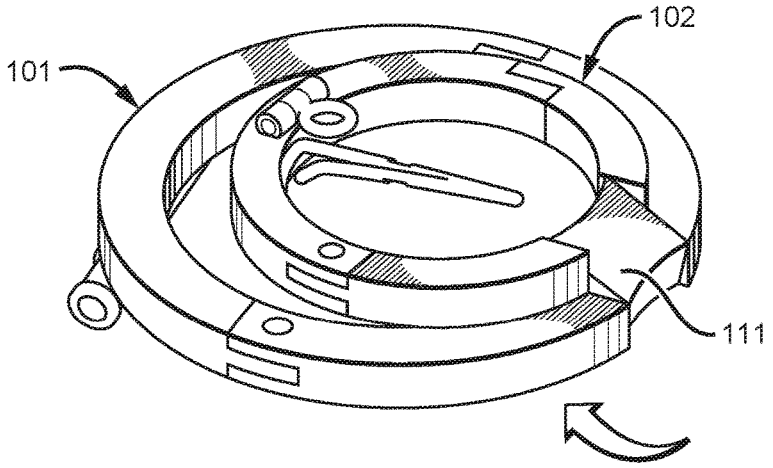
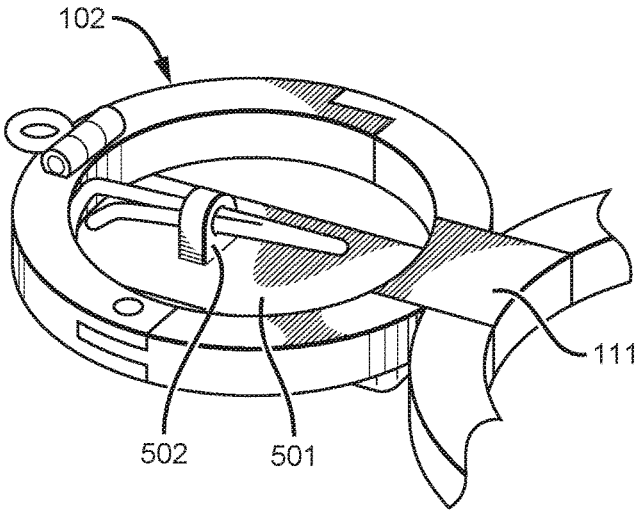
FIG. 11
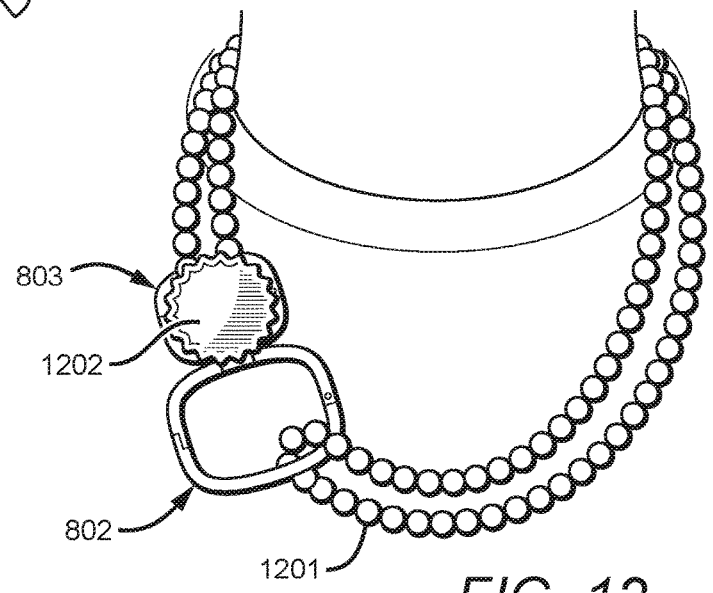
FIG. 12

JEWELRY ENHANCER

CROSS REFERENCE TO RELATED APPLICATIONS

This application claims the benefit of U.S. Provisional Application No. 62/360,342, filed on Jul. 9, 2016.

BACKGROUND OF THE INVENTION

Fashionable individuals commonly possess various types and items of jewelry that are designed to be worn in a specific manner. Repurposing jewelry is the process by which items of jewelry may be used in a different manner than the manner intended by the designer of the jewelry. Repurposing jewelry in this way allows a wearer to express her creativity and make unique or interesting aesthetic statements. Repurposing an item of jewelry also allows the owner of the item to save money by reusing an item already in her possession for a certain fashionable effect, instead of purchasing a new item of jewelry to achieve that fashionable affect. Repurposing an item of jewelry may reduce consumer waste in that items of jewelry that may have otherwise been discarded, forgotten, or never again used may be reused. Given these benefits, there is growing interest in repurposing jewelry and there is a need for items that assist individuals in repurposing jewelry.

In a basic sense, jewelry may be repurposed simply by wearing the jewelry in an unintended fashion. For example, a hair tie may be worn as a bracelet, a single earring may be affixed to an item of clothing as an adornment, or a pair of sunglasses could be worn on top of the head as a fashionable way to hold long hair out of the wearer's face. In other instances, an item may be repurposed by manipulating the item or combining the item with other items of jewelry. For example, a large earring could be attached to a chain in order to create a pendant necklace.

Certain items of jewelry may be particularly suitable for repurposing. Shank buttons are one such item. A jacket or sweater equipped with shank buttons may come with extra shank buttons, to be used in the event that one or more of the original shank buttons are lost. Extra shank buttons are frequently discarded, or are retained by their owner, but never used. Additionally, shank buttons are considered beautiful and are collected by many people, but one may have relatively few opportunities to wear a variety of shank buttons. Although it is common to repurpose shank buttons, such as by wearing them on a necklace, repurposing shank buttons can be difficult due to the weight of the shank button and the rigid shank-loop that protrudes from the rear of the shank button. If the loop of a shank button is attached to a flexible item such as a thread or a necklace, the weight of the button may pull the face of the shank button downward, producing an undesirable aesthetic. Securing a shank button such that the face of the button faces toward an observer may require sewing the button onto a piece of clothing, which has the disadvantages that sewing takes significant time and skill and permanently affixes the button to the clothing. Thus, there exists a need for a device and method that easily allows shank buttons to be fashionably and flexibly repurposed.

String-jewelry, such as flexible necklaces and bracelets, are popular items of jewelry and are sometimes repurposed. A necklace may be repurposed to be used as a multi-strand bracelet by looping the necklace over itself one or more times. However, if the multiple strands of the bracelet are not fastened to one another, the loops may spread apart on the arm, creating an undesirable aesthetic. Although items such as zip-ties may be used to hold together such strands, such items may not be fashionable, reusable, or easy to work with.

A fashionable individual may also wish to repurpose jewelry by creating new combinations and configurations of multiple pieces of a jewelry. For instance, it may be considered aesthetically pleasing to wear a bracelet fashioned from a repurposed necklace and combined with a distinctive shank button.

Others have recognized the advantage of repurposing jewelry and provided devices to assist in repurposing jewelry. U.S. Pat. No. 5,156,023 describes a multi-purpose pin which provides support for jewelry items, such that some items of jewelry may be repurposed. However, the pin of U.S. Pat. No. 5,156,023 only provides support for a few items of jewelry and cannot easily repurpose string-jewelry.

U.S. Pat. No. 6,422,036 describes a jewelry clasp that can secure two ends of a necklace and attach an additional item, such as a tassel or a bracelet, thereby repurposing the tassel or bracelet. However, the clasp of U.S. Pat. No. 6,422,036 is designed in the shape of a hollow, three-dimensional object and is therefore bulky and may result in an undesirable aesthetic. Because the securing means of the clasp are contained within a hollowed-out object, a shank button cannot be effectively secured and displayed.

Existing devices for repurposing jewelry have relatively limited functionality, meaning that it is necessary for an individual to obtain a wide range of such devices that allow repurposing of jewelry in different ways. There is thus a need for a device that provides multiple ways for jewelry to be repurposed.

SUMMARY OF THE INVENTION

This summary is provided to introduce in a simplified form concepts that are further described in the following detailed descriptions. This summary is not intended to identify key features or essential features of the claimed subject matter, nor is it to be construed as limiting the scope of the claimed subject matter.

In accordance with one or more aspects of the jewelry enhancer (which may be referred to by other names, such as Everything Enhancer) a device is provided that allows the repurposing in multiple ways of string jewelry and/or decorative items such as shank buttons, fashionably displays them, and may itself be worn as an adornment. The device comprises two hinged-rings, attached to each other by a folding-hinge. The hinged-rings can fold towards or away from each other by operation of the folding-hinge. Both hinged-rings may be opened and securely closed. A button-clip and a hoop are attached to one of the hinged-rings. A bar-pin is attached to the other hinged ring. A brooch-bar and a jewelry bale may be detachable affixed to the jewelry enhancer. The jewelry enhancer may secure and repurpose multiple items of jewelry and may itself be secured to a garment and worn as an adornment.

Advantages

Accordingly, several advantages of one or more aspects of the jewelry enhancer are that the jewelry enhancer may more easily be used to shorten or repurpose an item of string jewelry, keep together multiple strands of string jewelry worn on the wrist, display a shank button or other decorative items, attach to a garment, and attach to a necklace.

Other advantages of one or more aspects of the jewelry enhancer are that it is easier to apply and remove than other devices used for repurposing jewelry, shank buttons secured by the jewelry enhancer do not fall off axis due to their weight, the jewelry enhancer and accompanying jewelry may be more easily attached to garments or other items of jewelry, and the jewelry enhancer may produce a more desirable aesthetic than other devices used for repurposing jewelry. These and other advantages of one or more aspects will become apparent from a consideration of the ensuing description and accompanying drawings.

BRIEF DESCRIPTION OF THE DRAWINGS

FIG. 3 is an enlarged, broken away, rear view of a garment-securing-hinged-ring, as illustrated on the right-hand side of FIG. 1; the garment-securing-hinged-ring is shown in an open configuration.

FIG. 4 is an enlarged, broken away, rear view of a button-securing-hinged-ring, which appears on the left-hand side of FIG. 1; the button-securing-hinged-ring is shown in an open configuration.

FIG. 5 is an enlarged, broken away, side view of the button-securing-hinged-ring that is on the left-hand side of FIG. 1 and that is shown in FIG. 4; the button-securing-hinged-ring is in a closed configuration; a brooch bar is attached to a button-clip of the button-securing-hinged-ring and a jewelry bale is attached to the button-securing-hinged-ring by a hoop.

FIG. 6 is a front view of the first embodiment of a jewelry enhancer, in which the jewelry enhancer is affixed to the front of a jacket by a bar pin and in which a large shank-button is displayed by the jewelry enhancer.

FIG. 7 is a front view of the first embodiment of a jewelry enhancer, wherein the garment-securing-hinged-ring is securing two ends of a pearl necklace and the button-securing-hinged-ring is securing a large shank button.

FIG. 8 is a front view of the second embodiment of a jewelry enhancer, which is shown in FIG. 2; the jewelry enhancer is preventing multiple strands of a repurposed necklace from falling apart on the wrist of a user.

FIG. 9 is a front view of the second embodiment of a jewelry enhancer; a button-securing-hinged-ring is attached by a jewelry-bale to a pearl necklace and a garment-securing-hinged-ring hangs below the button-securing-hinged-ring; a brooch bar is shown, secured by the button clip, and a decorative tassel is shown attached to the garment-securing-hinged-ring.

FIG. 10 as a perspective view of a first embodiment of a jewelry enhancer, in which the jewelry enhancer is in a folded configuration.

FIG. 11 is an enlarged, broken away, perspective view of the button-securing-hinged-ring of the first embodiment, in which a brooch bar is attached to a button-clip.

FIG. 12 is a front view of the second embodiment of a jewelry enhancer in which the jewelry enhancer shortens a pearl necklace and displays a large shank button.

DETAILED DESCRIPTION OF THE INVENTION

Figure 1:
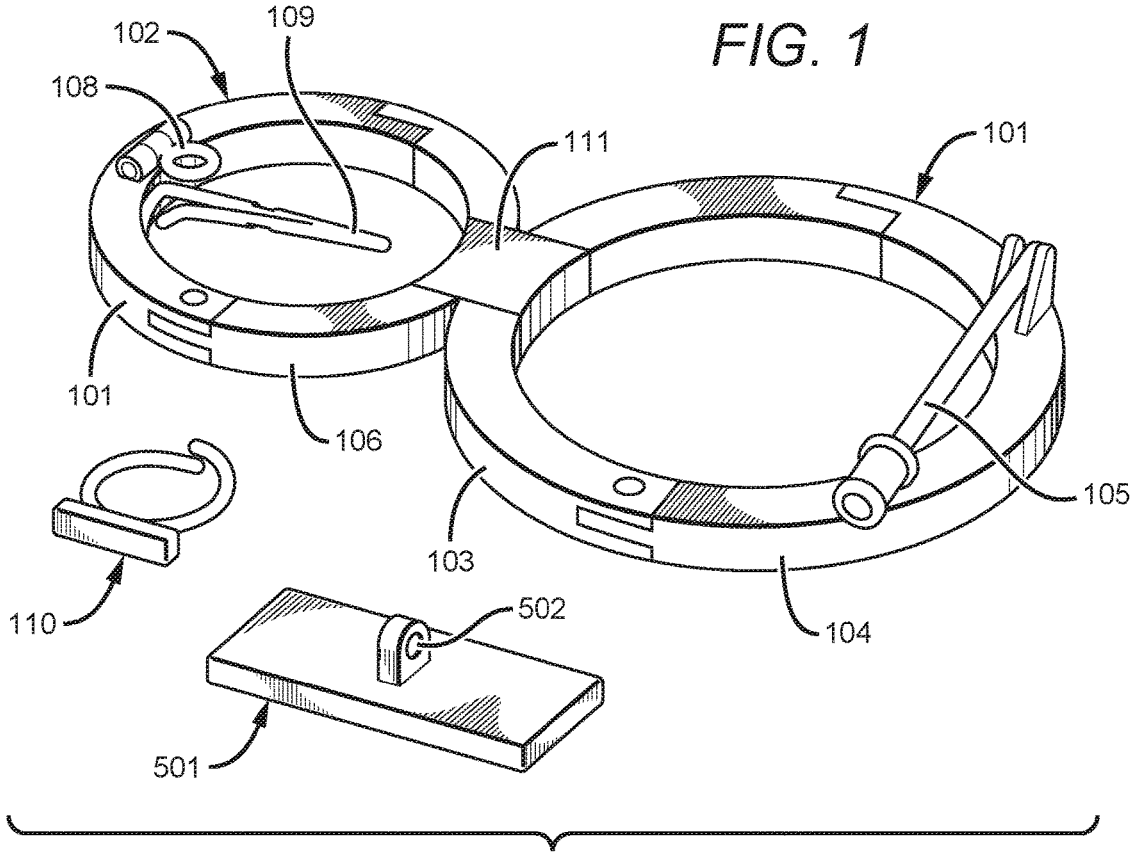
FIG. 1 is a rear view of a first embodiment of a jewelry enhancer.

First Embodiment FIGS. 1, 3, 5

Referring to FIGS. 1, 3, and 5, wherein like numerals indicate like elements throughout, there is shown a first embodiment of a jewelry enhancer. FIG. 1 illustrates a rear view of a first embodiment of the jewelry enhancer. This embodiment comprises a garment-securing-hinged-ring 101, illustrated on the right-hand side of FIG. 1, and a button-securing-hinged-ring 102, illustrated on the left-hand side of FIG. 1. The garment-securing-hinged-ring 101 of this embodiment is also illustrated in FIG. 3 (rear view, enlarged and broken away). The garment-securing-hinged-ring has an exterior radius of approximately 12.5 mm, an interior radius of approximately 10 mm, a thickness of approximately 2.5 mm a front face, a rear face and comprises a fixed member 103 and a pivotal member 104.

The fixed-member 103 is generally semicircular in shape. It has a hinging end 301, a clasping end 302, a radially interior face, a radially exterior face, a front face and a rear face. The pivotal member 104 is generally semicircular in shape. It has a hinging end 303, a clasping end 304, a radially interior face, a radially exterior face, a front face and a rear face. The hinging end of the fixed member is attached to the hinging end of the pivotal member by a first hinge-pin 305. A convex bump 306 is attached to the clasping end 304 of the pivotal member and a concave indentation 307 is imprinted on the clasping end 302 of the fixed member, wherein the indentation has generally the same dimensions as the bump. Also illustrated in FIGS. 1 and 3 is a bar-pin 105 with a sharp end and a swiveling end. The swiveling end of the pin is attached to the rear face of the pivotal member using a pin-swivel 308. A pin-catch 309 is attached to the rear face of the pivotal member of the garment-securing-hinged-ring in a configuration such that the sharp end of the pin may rest in the pin-catch 309.

The button-securing-hinged-ring of this embodiment is illustrated in FIG. 4 (rear view, enlarged and broken away). The button-securing-hinged-ring has an exterior radius of approximately 10 mm, an interior radius of approximately 7.5 mm, a thickness of approximately 2.5 mm, a front face, a rear face and comprises a fixed member 106 and a pivotal member 107.

The fixed-member 106 of the button-securing-hinged-ring is generally semicircular in shape. It has a hinging end 401, a clasping end 402, a radially interior face, a radially exterior face, a front face and a rear face. The pivotal member the button-securing-hinged-ring is generally semicircular in shape. It has a hinging end 403, a clasping end 404, a radially interior face, a radially exterior face, a front face and a rear face. The hinging end of the fixed member is attached to the hinging end of the pivotal member by a second hinge-pin 405. A convex bump 406 is attached to the clasping end of the pivotal member and a concave indentation 407 is imprinted on the clasping end of the fixed member, wherein the indentation has generally the same dimensions as the bump.

Also illustrated in FIG. 4 is a hoop 108, with an eyelet and a swiveling end. The swiveling end of the hoop is attached to the rear face of the pivotal member of the button-securing-hinged-ring by a hoop-swivel, such that the eyelet of the hoop may extend either radially outward or radially inward, relative to the curvature of the button-securing-hinged-ring.

A button-clip 109, having a first end 408, a kink 409, a notch 410 and a second 411 end is illustrated in FIGS. 1 and 4. The button-clip 109 is constructed of material such as gold or surgical steel that is capable of a small amount of bending at the kink and will produce some elasticity when bent. The first end of the button-clip 408 is attached to the pivotal member 107 of the button-securing-hinged-ring, such that the kink extends radially inward.

FIG. 5 illustrates a brooch bar 501 having a front face, a rear face and a shank 502. The radius of the shank is approximately the same as the radius of a shank on a standard shank-button. The shank 502 is attached to the rear face of the brooch bar 501. In FIG. 5, the brooch bar 501 is secured to the button-clip 109. Also illustrated in FIG. 5 is a jewelry bale 110 attached to the hoop 108. The jewelry bale 110 is illustrated in a detached configuration in FIG. 1.

The fixed member 103 of the garment-securing-hinged-ring is attached to the fixed member 106 of the button-securing-hinged-ring by a folding-hinge 111, illustrated in FIGS. 1 and 10.

Adornments of various types may be affixed to the various faces and components of the jewelry enhancer to create a desirable aesthetic. For example, rhinestones may be affixed to the front faces of the brooch bar, the hinged-rings, and the jewelry bale.

Various types of metal, metal alloy or plastic may be used for the components of the jewelry enhancer. Some metals, such as gold or surgical steel may be more suitable for parts of the jewelry enhancer that experience repetitive stress. For example, the clasping ends 302, 304, 402, 404 and associated bumps 306, 406 and indentations 407 and button-clip 108 may deform or connections may become loose after repeated clasping and unclasping, if constructed of metals such as bronze. Surgical steel, plastic or gold may allow for more opening and closing repetitions without the clasping mechanisms becoming loose or deformed.

Operation of First Embodiment FIGS. 1, 3, 4, 5, 6, 7, 10, 11

Referring to FIGS. 1, 3, 4, 5, 6, 7, 10, and 11, wherein like numerals indicate like elements throughout, there is shown a first embodiment of a jewelry enhancer. In at least one embodiment of the jewelry enhancer, a garment-securing-hinged-ring 101 can be positioned in an open configuration or in a closed configuration. FIG. 3 illustrates the garment-securing-hinged-ring 101 in an open configuration, while FIG. 1 illustrates the garment-securing-hinged-ring 101 in a closed configuration. When the garment-securing-hinged-ring is in a closed configuration, it forms an annular ring. The garment-securing-hinged-ring may be moved from an open to a closed configuration by pushing the pivotal 104 and fixed 103 members toward each other. As the clasping ends of the pivotal and fixed members come together, the bump 306 and corresponding indentation 307 on the clasping ends couple, such that the clasping ends will not separate without sufficient force. The closed garment-securing-hinged-ring may be opened by pulling the pivotal and fixed members apart with sufficient force.

In at least one embodiment, the button-securing-hinged-ring may be opened and closed in the same manner as the garment-securing-hinged-ring. FIG. 1 illustrates the button-securing-hinged-ring in a closed configuration and FIG. 4 illustrates the button-securing-hinged-ring in an open configuration. When the button-securing-hinged-ring 101 is in a closed configuration, it forms an annular ring.

FIG. 3 also illustrates the bar-pin 105 attached to the pivotal member of the garment-securing-hinged-ring 101, in a closed configuration. The bar-pin 105 operates in a similar manner to a standard bar-pin. The bar-pin may be moved into an open configuration by disengaging the pin-catch 309 and swiveling the bar-pin. A user may affix the jewelry enhancer to fabric by opening the bar-pin 105, threading the sharp end through the material, resting the sharp end in the pin-catch 309, and closing the pin catch.

FIG. 5 illustrates the manner in which a brooch-bar 501 or button shank may be secured by the button-clip 109 in at least one embodiment. The user slides the shank 502 of the brooch-bar 501 over the kink 409 of the button clip 109 and toward the ends 408 and 411 of the button-clip. The shank 502 will click into place when it reaches the notch 410 and then will be held securely. To release the brooch-bar 501, a user squeezes together the first end 408 and second end 411 of the button-clip 109 and slides the brooch-bar 501 towards the kink 409. A shank-button with a standard shank may be applied and removed in the same manner.

In FIG. 6, an embodiment of the jewelry enhancer is affixed to the breast of a garment 601, such as a jacket or shirt, using the bar-pin 105 as described above. The bar-pin 105 supports the weight of the jewelry enhancer and the button-securing-hinged-ring hangs below the garment-securing-hinged-ring 101. In FIG. 6, a large shank-button 602 is secured by the button-clip, such that the entire button-securing-hinged ring is eclipsed by the shank-button and is not visible to the observer.

In FIG. 7, an embodiment of the jewelry enhancer is used to shorten a pearl necklace 701. As in FIG. 6, a large shank-button 602 is secured by the button-clip, such that the entire button-securing-hinged-ring is eclipsed by the shank-button and is not visible to the observer. A user may shorten a pearl necklace by first placing the pearl necklace in a configuration such that it forms a single, closed loop. The closed loop is held at two opposite points and stretched taught, forming a line of two strands of pearls. Keeping the two strands of pearls together, the user bends the line into a loop by bringing the two endpoints of the line together. The newly formed loop is approximately half the diameter of the original loop and consists of two strands of pearls. The two endpoints of the newly formed loop are secured by closing the garment-securing-hinged-ring 101 around them, thereby creating a pearl necklace with two strands that is approximately half the length of the original pearl necklace.

In FIG. 10, a first embodiment of the jewelry enhancer is depicted in a folded configuration. The folding-hinge 111 allows the button-securing-hinged-ring 102 and the garment-securing-hinged-ring 101 to fold towards one another, such that the rear faces of both hinged-rings face each other or such that the front faces of both hinged-rings face each other. Folding the hinged-rings together can produce a desirable aesthetic and the entire jewelry enhancer may be worn as an adornment.

FIG. 11 depicts an enlarged, broken away, perspective view of the button-securing-hinged-ring 102 of the first embodiment, in which a brooch bar 501 is attached to a button-clip 109. The shank 502 that is attached to the rear face of the brooch bar is passed over the kink 409 and towards the endpoints of the button-clip 408 and 411. The shank 502 is secured by the notch 410 in the button-clip 409.

Figure 2:
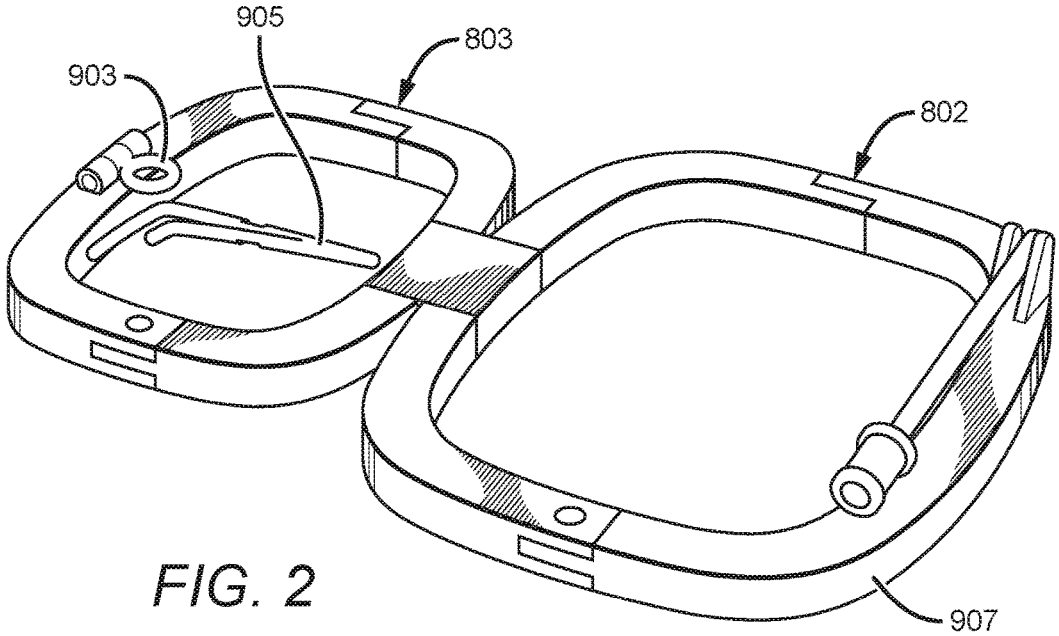
FIG. 2 is a rear view of a second embodiment of a jewelry enhancer.

Second Embodiment—FIGS. 2, 8, 9

A second embodiment of the jewelry enhancer is shown in FIGS. 2, 8, and 9. In this embodiment, the shape of the hinged rings is rectangular, as opposed to annular. This embodiment is otherwise substantially the same in size, construction and operation.

Operation of Second Embodiment—FIGS. 8, 9, 12

The embodiment illustrated in FIGS. 2, 8, 9 and 12 operates in substantially the same manner as the first embodiment discussed above. Thus, this additional embodiment may accomplish the operations discussed above and the embodiments discussed above may accomplish the operations discussed in relation to this embodiment.

In FIG. 8, the additional embodiment of the jewelry enhancer is used to transform a pearl necklace 801 into a multi-strand bracelet on the wrist of a user. In order to create the multi-strand bracelet from a pearl necklace, a user begins with a pearl necklace configured in a closed loop. The user twists one half of the loop approximately 180 degrees so that the necklace forms a figure-8. The one half of the figure-8 is then folded on top of the other half. Depending on the length of the necklace and the desired length of the bracelet, this process can be repeated multiple times. Once the desired bracelet length is achieved, the user closes the garment-securing-hinged-ring 802 and button securing hinged ring 803 around the multiple strands of the bracelet. FIG. 8 depicts a pearl necklace that has been looped and folded only once, producing a bracelet of two strands. The jewelry enhancer prevents the strands of the bracelet from separating on the user's forearm and produces a fashionable aesthetic. In FIG. 8, the front faces of the hinged-rings are facing away from the wrist and will be visible. If a user desires to wear multiple, independent bracelets, the jewelry enhancer may be used to keep the multiple bracelets together on the wrist, in the same manner.

In FIG. 9, the additional embodiment of the jewelry enhancer is attached to a pearl necklace 901, in order to be worn as an adornment. A jewelry-bale 902 is connected to a hoop 903 on the rear face of the button-securing-hinged-ring 803 and connected to the pearl necklace 901, thereby securing the jewelry enhancer to the necklace. The garment-securing-hinged-ring 802 hangs below the button-securing-hinged-ring 803. A brooch-bar 904 is attached to the button-clip 905 in order to hide the button-clip 905 from the view of an observer and produce a desired aesthetic. A tassel 906 is hung on the pivotal-member 907 of the garment-securing-hinged-ring 802, for fashionable effect.

In FIG. 12 an embodiment of the jewelry enhancer is again used to shorten a pearl necklace. A pearl necklace 1201 is configured in the same manner as described above, in FIG. 7. In FIG. 12, instead of securing both endpoints of the shortened necklace with a garment-securing-hinged-ring, only one endpoint is secured by the garment-securing-hinged-ring 802. The other endpoint is secured by the button-securing-hinged-ring 803. A large shank button 1202 is attached to the button-clip 905.

Figure 13:
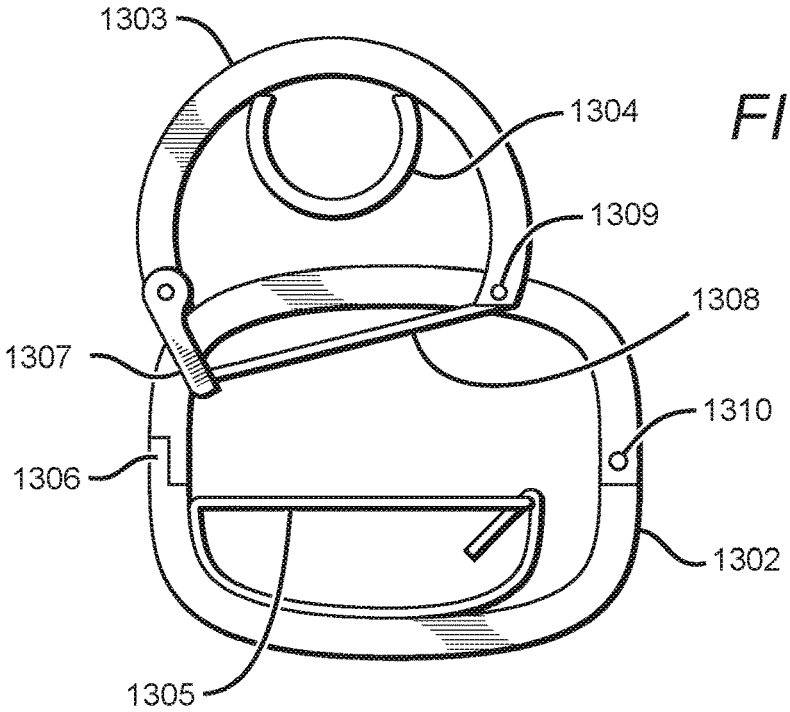
FIG. 13 is a rear view of a third embodiment of a jewelry enhancer, in a closed configuration.
Figure 14:
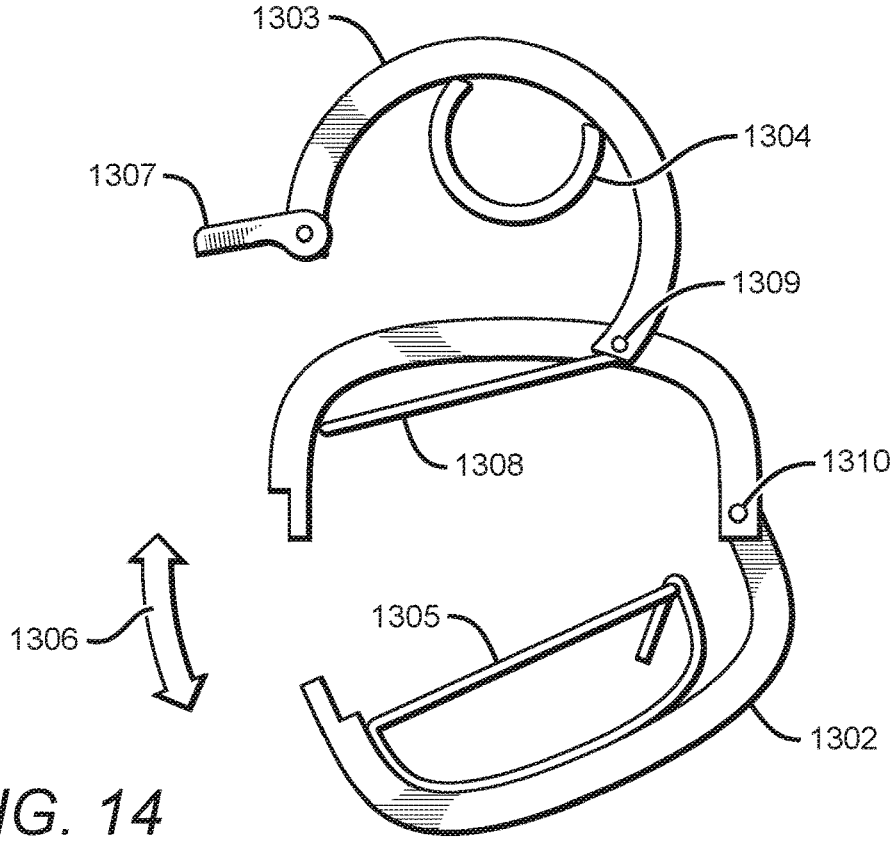
FIG. 14 is a rear view of a third embodiment of a jewelry enhancer, in an open configuration.

Third Embodiment—FIGS. 13, 14

FIGS. 13 and 14 illustrates another embodiment of the jewelry enhancer of the present invention. Outer ring 1302 is a ring comprising an outer ring hinge point 1310, an opening hinge 1306, a first end and a second end. The first end of the outer ring 1302 is coupled to a hinged ring 1303. A first bar pin 1308 has a large hinge closure 1307 on the outer ring 1302 attached at a strong hinge point 1309 to the hinged ring 1303. A standard jump ring 1304 is coupled to the hinged ring 1303 so that the standard jump ring 1304 is contained within the hinged ring 1303. In this embodiment, the outer ring opening hinge 1306 is closed.

In an embodiment, the hinged ring 1303 and the standard jump ring 1304 hold pieces of jewelry, and are pivoted down as a unit at the strong hinge point 1309 to the back of the jewelry enhancer where they become invisible. In an embodiment, although the hinged ring 1303 and the standard jump ring 1304 can be opened independently, they are attached and share a common hinge at the strong hinge point 1309, and pivot down as one unit. In this embodiment, both the hinged ring 1303 and the standard jump ring 1304 are visible when deployed and invisible when pivoted down and laying flush against the back of the jewelry enhancer 1301.

In the embodiment illustrated in FIG. 13, the outer ring 1302, hinged ring 1303 and standard jump ring 1304 are circular or oval shapes. In other embodiments, the outer ring 1302, hinged ring 1303 and standard jump ring 1304 may have a square or rectangular shape.

A second bar pin 1305 initiates below the hinge point 1310 of the outer ring 1302, and it terminates on the other side of the outer ring 1302 below an opening hinge 1306, such that it is parallel to an outer ring hinge mechanism comprising the hinge point 1310 and the opening hinge 1306.

FIG. 14 illustrates another embodiment of the invention, where the outer ring hinging mechanism is opened. Outer ring 1302 is opened at the hinge point 1310 to make an opening at the opening hinge 1306.

In an embodiment, the outer ring 1302 has a diameter between about one inch and about 4 inches in diameter.

In an embodiment, the jewelry enhancer may be worn on a chain as a piece of adornment by opening any of the outer ring 1302, the hinged ring 1303, or the standard jump ring 1304, each of which may be opened independently.

In another embodiment, the jewelry enhancer 1301 may be attached with the second bar pin 1305 and worn.

In an embodiment, the outer ring 1302 opens at the hinge point 1310 to form an opening at the opening hinge 1306, then closes, to function as a clasp. In an embodiment, the outer ring opening hinge 1306 is approximately 1-inch wide when fully open, and may hold multiple bracelets, transforming bracelets to have multiple desirable widths. Similarly, in another embodiment, the jewelry enhancer may hold multiple necklaces, transforming necklaces to have multiple desirable widths.

In an embodiment, the jewelry enhancer may be employed to shorten necklaces or widen bracelets. For example, a 32-inch strand of 5 mm pearls may be transformed into a perfect double row of 16.5 inch pearls by simply opening the outer ring 1302, folding the strand in half around the opening hinge 1306, and then closing the opening hinge 1306 after the strand of pearls have been placed around a person's neck. Similarly, the same could be done to create a shorter necklace or multiple bracelets—in this case a bracelet comprised of four strands of pearls, by simply opening the outer ring 1302, folding the 32-inch strand four times around the opening hinge 1306 and then closing the opening hinge 106.

In another embodiment, the jewelry enhancer stabilizes shank buttons. This is an outstanding feature since a shank in the middle of a button makes it impossible for it to simply hang from a chain because the center of gravity is at the center of the shank button, which causes it to fall forward. A shank button is stabilized by securing the shank button in place with either the first bar pin 1308 or the second bar pin 1305 or both.

CONCLUSIONS, RAMIFICATIONS, AND SCOPE

Accordingly, the reader will see that at least one embodiment of the jewelry enhancer can be used to shorten or repurpose an item of string jewelry, keep together multiple strands of string jewelry, display a shank button or other decorative item, attach to a garment, attach to a necklace, and be worn as an adornment. Furthermore, at least one embodiment of the jewelry enhancer has additional advantages in that:

a. The hinged rings of the jewelry enhancer open and close more easily and without damaging the jewelry enhancer. Thus, the jewelry enhancer can be more easily moved from one item of jewelry to another.

b. The button-clip more easily and securely displays a shank-button such that the weight of the button does not pull the front face of the button downwards. This prevents the need for sewing or other time-intensive manners of properly displaying a shank button.

c. The jewelry enhancer is more easily affixed and removed from garments and jewelry by using the bar-pin and jewelry-bale.

While the above description contains many specificities, these should not be construed as limitations on the scope, but rather as an exemplification of one or several embodiments thereof. Many other variations are possible. For example:

a. The hinged-rings may be made in different shapes, such as triangles, hexagons, or even irregular shapes. The hinged-rings may also be made in shapes that are different from each other.

b. The hinged-rings may be made in different sizes. Larger hinged-rings may accommodate larger string jewelry, or more strands of string jewelry, whereas smaller hinged-rings may be desirable for use with smaller jewelry. The hinged-rings may also be made in various sizes relative to each other.

c. The various components of the jewelry enhancer may be made of various different materials. Although some may prefer a metal, metal alloy, or a precious metal, a plastic construction may produce advantages such as reduced weight or cost of production.

d. The elements that are attached to the hinged-rings may be eliminated or duplicated, or moved to other parts of the hinged-rings.

e. The size and shape of the button-clip may be adjusted to better accommodate attachments of sizes other than the standard shank-button.

f. The hoop attached to the button-securing-hinged-ring may be configured in different sizes, shapes or angles to accommodate different sized jewelry bales or necklaces.

g. The bar-pin, hoop, and jewelry-bale may be replaced with other items that may secure the jewelry enhancer to a garment or piece of string jewelry.

h. The hinges of the hinged-rings may be substituted for another item that allows the members of the hinged-rings to pivot with respect to each other.

i. The bumps and indentations used to securely close the hinged rings may be substituted for another item that allows the hinged rings to close securely.

j. The strong-hinge may be replaced by another item that allows the hinged rings to fold towards and away from one another or that allows the hinged rings to rotate with respect to one another. Alternatively, the strong hinge may be removed and the hinged-rings may be connected.

The various embodiments of the jewelry enhancer may also have operations other than those described above. For example:

a. The jewelry enhancer may be used as a scarf ring, fastener, or belt closure.

b. String jewelry may be repurposed or held together in various other ways such as holding together multiple necklaces.

c. The jewelry enhancer may also be affixed in various different manners to various types of garments, hats, shoes, jewelry or accessories.

d. The button-clip may be used for various purposes including securing various decorative items or hooking the jewelry enhancer to another object.

Accordingly, the scope should be determined not by the embodiments illustrated, but by the appended claims and their legal equivalents.

What is claimed is:

1. A device to which jewelry may be affixed, comprising:

a first hinged-ring;

wherein the first hinged-ring comprises two separable parts aligned in a common plane and connected by a first hinge, the rotational axis of said first hinge being arranged perpendicular to the plane of the first hinged-ring;

a bar-pin attached to the first hinged-ring;

a second hinged-ring;

wherein the second hinged-ring comprises two separable parts aligned in a common plane and connected by a second hinge, the rotational axis of said second hinge being arranged perpendicular to the plane of the second hinged-ring;

a swiveling hoop attached to the second hinged-ring;

a button-clip attached to the second hinged-ring; and wherein the first hinged-ring and the second hinged-ring are attached to a folding-hinge.

2. The device of claim 1, further comprising a jewelry-bale removably attached to said hoop.

3. The device of claim 1, further comprising a brooch-bar, removably attached to said button-clip.

4. The device of claim 3, wherein the brooch bar comprises:

a front face;

a rear face; and a shank protruding perpendicularly from the rear face;

wherein the shank comprises a loop with an eye; and wherein the axis around which the loop is formed is substantially perpendicular to the rear face of the brooch bar.

5. The device of claim 1 wherein the swiveling hoop comprises:

a swiveling end; and an eye;

wherein the swiveling end is attached to the second hinged-ring using a means for swiveling the swiveling hoop with respect to the second hinged-ring.

6. The device of claim 1 wherein:

the first hinged-ring further comprises an exterior radius, an interior radius, a front face, and a rear face;

the second hinged-ring further comprises an exterior radius, an interior radius, a front face, and a rear face;

the interior radius of the first hinged-ring is approximately equal to the exterior radius of the second hinged-ring;

the first hinged-ring is configured to rotate about a first folding axis of rotation of the folding-hinge;

the second hinged-ring is configured to rotate about a second folding axis of rotation of the folding-hinge, such that the exterior radius of the second hinged-ring may nest with the interior radius of the first hinged ring; and wherein the first and second folding axes of rotation are parallel.

7. A device comprising:

a first hinged-ring attached to a second hinged-ring;

wherein the first hinged-ring comprises two separable parts aligned in a common plane and connected by a first hinge, the rotational axis of said first hinge being arranged perpendicular to the plane of the first hinged-ring;

wherein the second hinged-ring comprises two separable parts aligned in a common plane and connected by a second hinge, the rotational axis of said second hinge being arranged perpendicular to the plane of the second hinged-ring;

a button-clip, wherein said button-clip is attached to said second hinged-ring;

a bar-pin, attached to said first hinged-ring;

and a hoop pivotally attached to said second hinged-ring.

8. A device comprising:

a first hinged-ring attached to a second hinged-ring;

wherein the first hinged-ring comprises two separable parts aligned in a common plane and connected by a first hinge, the rotational axis of said first hinge being arranged perpendicular to the plane of the first hinged-ring;

wherein the second hinged-ring comprises two separable parts aligned in a common plane and connected by a second hinge, the rotational axis of said second hinge being arranged perpendicular to the plane of the second hinged-ring;

wherein said first and second hinged-rings are pivotally attached such that said hinged-rings may fold axially with respect to each other;

a button-clip, wherein said button-clip is attached to said second hinged-ring; and a bar-pin, attached to said first hinged-ring.

9. A device to which jewelry may be affixed, comprising:

a first hinged-ring;

a bar-pin attached to the first hinged-ring for securing the first hinged-ring to a piece of fabric;

a second hinged-ring;

a swiveling hoop attached to the second ring for attaching a piece of jewelry;

a button-clip attached to the second ring for attaching a piece of jewelry;

wherein the first hinged-ring is attached to the second hinged-ring by a folding-hinge such that the first hinged-ring and second hinged-ring may fold towards one another; and wherein a hinge in each hinged-ring allows the ring to be opened and closed to secure one or more pieces of jewelry; and wherein said button-clip comprises a first end, a notch, a kink, and a second end, wherein said first end is attached to said second hinged-ring, said kink extends radially inward, said kink is configured in an acute angle and said notch comprises a first indentation on said button-clip in between said first end and said kink and a second indentation on said loop securing means in between said kink and said second indentation.

* * * * *